US008953746B2

(12) United States Patent
Roshi et al.

(10) Patent No.: US 8,953,746 B2
(45) Date of Patent: Feb. 10, 2015

(54) MULTI-CATHODE X-RAY TUBES WITH STAGGERED FOCAL SPOTS, AND SYSTEMS AND METHODS USING SAME

(75) Inventors: Aleksander Roshi, Medford, MA (US); Ram Naidu, Newtown, MA (US); David Schafer, Rowley, MA (US)

(73) Assignee: Analogic Corporation, Peabody, MA (US)

( * ) Notice: Subject to any disclaimer, the term of this patent is extended or adjusted under 35 U.S.C. 154(b) by 1019 days.

(21) Appl. No.: 13/059,089

(22) PCT Filed: Aug. 29, 2008

(86) PCT No.: PCT/US2008/074841

§ 371 (c)(1), (2), (4) Date: Apr. 26, 2011

(87) PCT Pub. No.: WO2010/024821

PCT Pub. Date: Mar. 4, 2010

(65) Prior Publication Data

US 2011/0188625 A1 Aug. 4, 2011
US 2012/0128117 A2 May 24, 2012

(51) Int. Cl.

*H01J 35/06* (2006.01)
*H01J 35/14* (2006.01)
*H01J 35/24* (2006.01)

(52) U.S. Cl.

CPC ..... *H01J 35/06* (2013.01); *H01J 35/14* (2013.01); *H01J 35/24* (2013.01); *H01J 2235/068* (2013.01)

USPC ..... 378/134; 378/125; 378/137

(58) Field of Classification Search

USPC ..... 378/119–144

See application file for complete search history.

(56) References Cited

U.S. PATENT DOCUMENTS

| | | | | |
|---|---|---|---|---|
| 3,946,261 | A * | 3/1976 | Holland et al. | 378/134 |
| 5,469,429 | A * | 11/1995 | Yamazaki et al. | 378/19 |
| 5,570,403 | A * | 10/1996 | Yamazaki et al. | 378/5 |
| 7,050,540 | B2 * | 5/2006 | Wilkins et al. | 378/124 |
| 7,085,354 | B2 * | 8/2006 | Kanagami | 378/136 |
| 7,120,222 | B2 * | 10/2006 | Hoffman | 378/5 |
| 7,187,756 | B2 * | 3/2007 | Gohno et al. | 378/124 |
| 7,308,078 | B2 * | 12/2007 | Wilkins et al. | 378/124 |
| 2007/0242797 | A1 * | 10/2007 | Stewart et al. | 378/16 |

FOREIGN PATENT DOCUMENTS

| | | |
|---|---|---|
| DE | 3635395 | 4/1987 |
| DE | 9113972 | 1/1992 |

OTHER PUBLICATIONS

International Search Report and the Written Opinion from Corresponding PCT Application No. PCT/US2008/074841 dated Sep. 25, 2009.

* cited by examiner

*Primary Examiner* — Thomas R Artman
(74) *Attorney, Agent, or Firm* — McDermott Will & Emery LLP

(57) ABSTRACT

A source of X-rays including at least two cathodes and at least one common anode configured and arranged so as to generate at least two spaced apart beams of X-rays emanating from respectively different locations of the anode, and separately controlled so as to be generated independently of one another. The staggered focal spots can be generated simultaneously or alternately as required. An X-ray imaging system comprising such an X-rays source, and a method utilizing such a source are also disclosed.

21 Claims, 8 Drawing Sheets

MULTI-CATHODE X-RAY TUBES WITH STAGGERED FOCAL SPOTS, AND SYSTEMS AND METHODS USING SAME

RELATED APPLICATIONS

This application is the U.S. National Stage of International Application No. PCT/US2008/074841. filed Aug. 29, 2008, the entire teachings of these applications are incorporated herein by reference.

FIELD OF DISCLOSURE

The disclosure related to X-ray tubes and systems and methods using same, and more particularly to a multiple cathode X-ray tube constructed to produce staggered focal spots and systems and methods using same.

CITED ART

U.S. Pat. No. 3,946,261 (Holland et al.) and U.S. Pat. No. 4,685,118 (Furbee et al.)

BACKGROUND

CT scanners employ dual energy techniques for a variety of applications including those in the medical and security areas. These dual energy techniques require measurements using two sets of input X-ray spectra with different energies. Dual energy scanners are known to generate dual energy X-rays using two focal spots generated respectively by two X-ray tubes operating at correspondingly two different voltages such that the focal spots are staggered with respect to each other. Each tube includes its own cathode and anode, and must be separately powered, and must be separately mounted, aligned, calibrated and maintained.

SUMMARY OF THE DISCLOSURE

A source of X-rays including at least two cathodes and at least one common anode configured and arranged so as to generate at least two spaced apart beams of X-rays emanating from respectively different locations of the anode, and separately controlled so as to be generated independently of one another. The staggered focal spots can be generated simultaneously or alternately as required. An X-ray imaging system comprising such an X-rays source, and a method utilizing such a source are also disclosed.

BRIEF DESCRIPTION OF THE DRAWINGS

The drawing figures depict preferred embodiments by way of example, not by way of limitations. In the figures, like reference numerals refer to the same or similar elements.

DETAILED DESCRIPTION OF THE DRAWINGS

Figure 1:
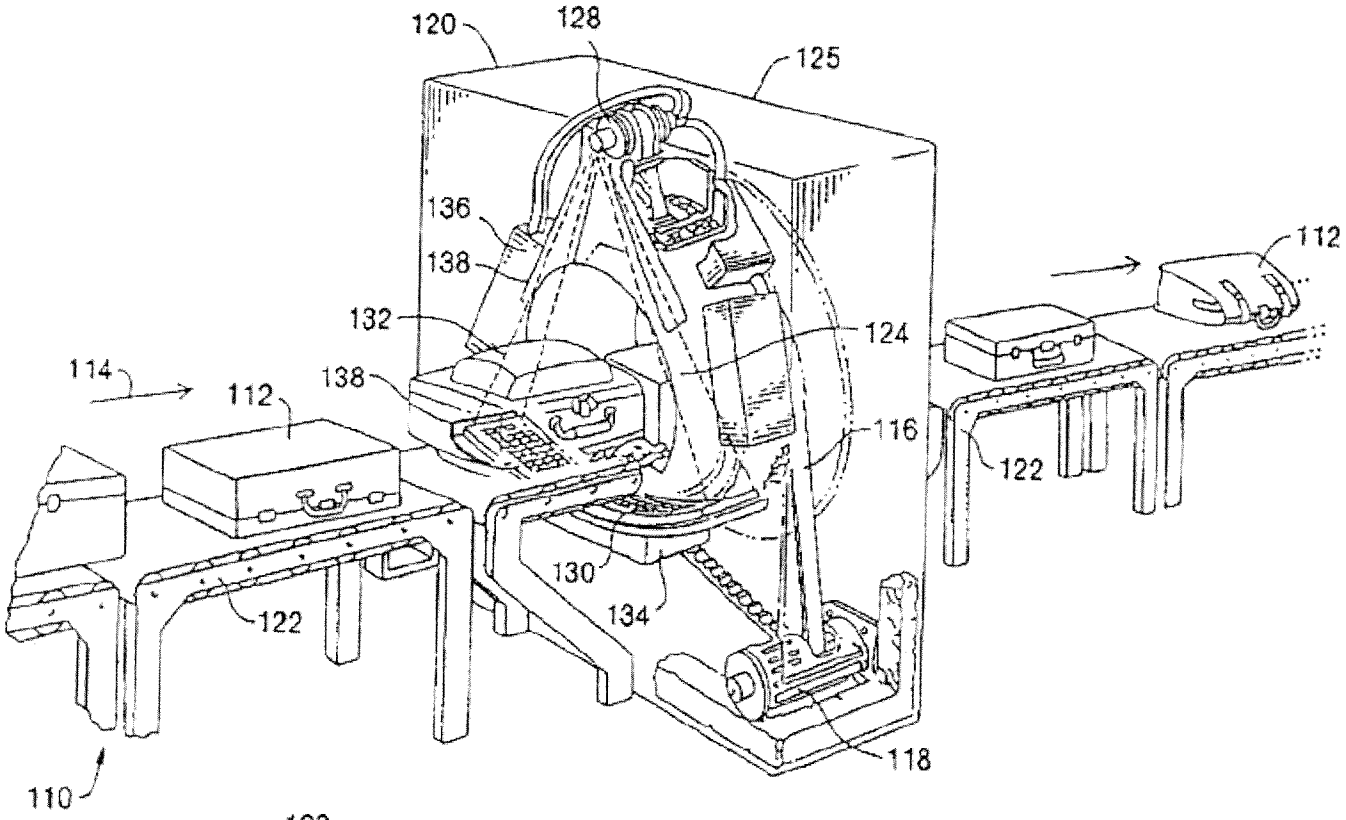
FIG. 1 is a perspective view of a baggage scanning system including the X-ray source designed to provide at least two which can be adapted to incorporate the system and perform method described herein.
Figure 2:
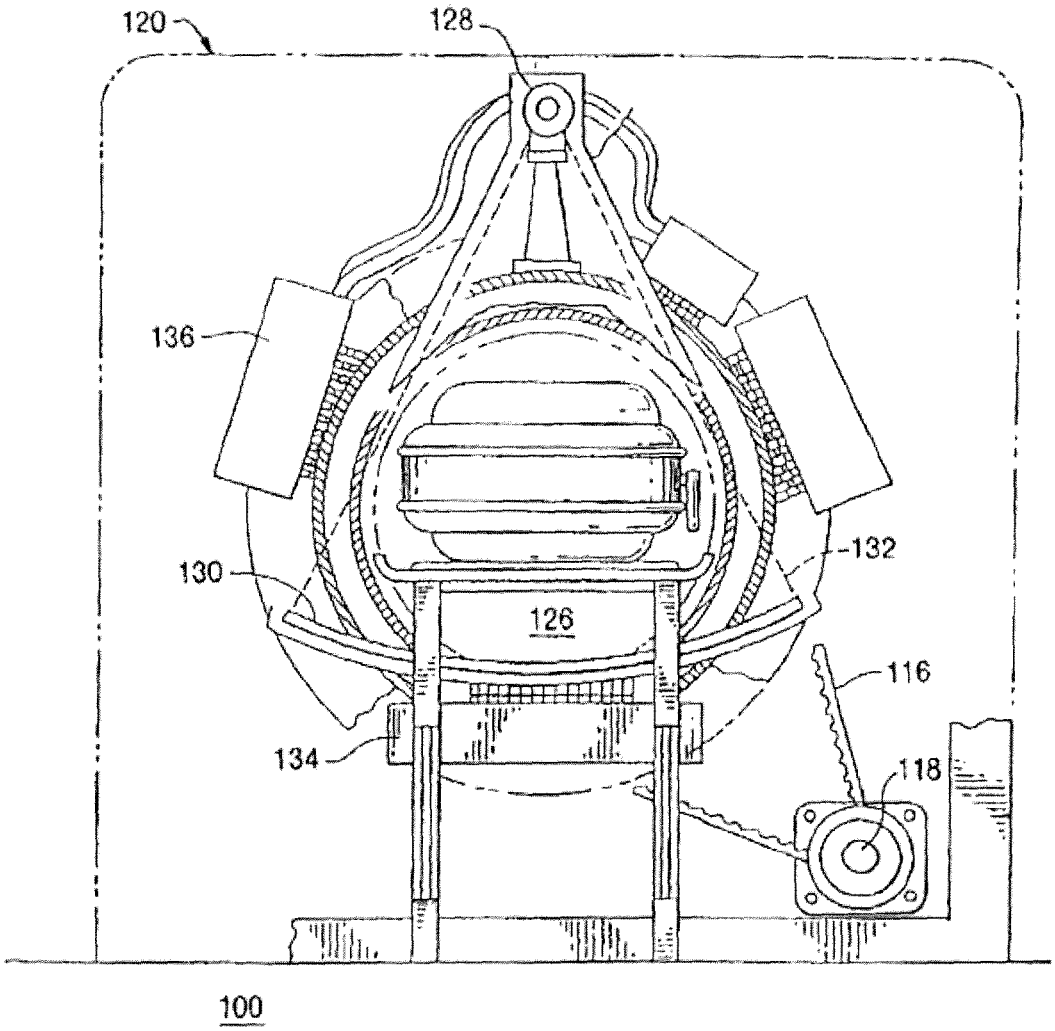
FIG. 2 is a cross-sectional end view of the system of FIG. 1.
Figure 3:
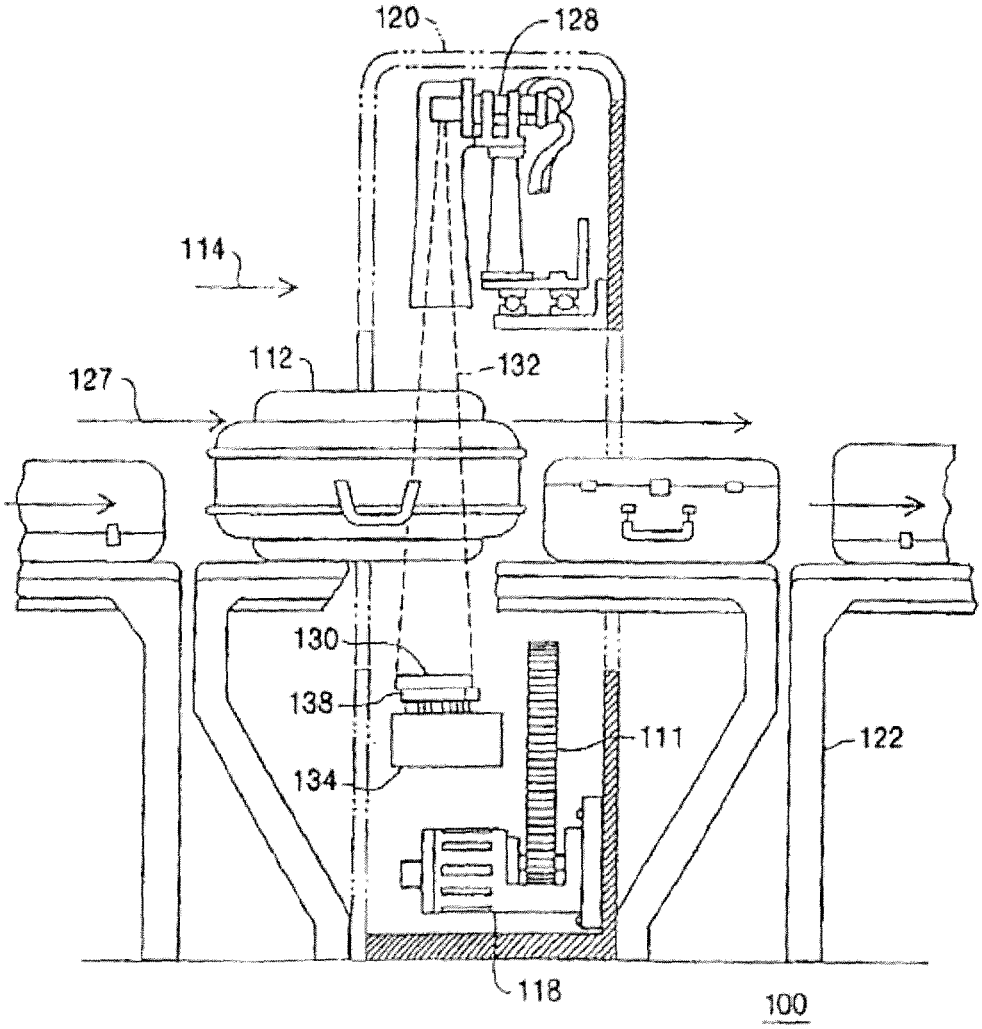
FIG. 3 is a cross-sectional radial view of the system of FIG. 1.

Referring to the drawings, FIGS. 1, 2 and 3 show perspective, end cross-sectional and radial cross-sectional views, respectively, of one embodiment of a baggage scanning system incorporating an X-ray source including at least two cathodes and at least one common anode configured and arranged so as to generate at least two spaced apart beams of X-rays emanating from respectively different locations of the anode, and separately controlled so as to be generated independently of one another. The baggage scanning system 100 includes a conveyor system 110 for continuously conveying baggage or luggage 112 in a direction indicated by arrow 114 through a central aperture of a CT scanning system 120. The conveyor system includes motor driven belts for supporting the baggage. Conveyer system 110 is illustrated as including a plurality of individual conveyor sections 122; however, other forms of conveyor systems may be used.

The CT scanning system 120 includes an annular shaped rotating platform, or disk, 124 disposed within a gantry support 125 for rotation about a rotation axis 127 (shown in FIG. 3) that is preferably parallel to the direction of travel 114 of the baggage 112. Disk 124 is driven about rotation axis 127 by any suitable drive mechanism, such as a belt 116 and motor drive system 118, or other suitable drive mechanism, such as the one described in U.S. Pat. No. 5,473,657 issued Dec. 5, 1995 to Gilbert McKenna, entitled "X-ray Tomographic Scanning System," which is assigned to the present assignee and, which is incorporated herein in its entirety by reference. Rotating platform 124 defines a central aperture 126 through which conveyor system 110 transports the baggage 112.

The system 120 includes an X-ray tube 128, an embodiment of which is described more fully below, and a detector array 130 which are disposed on diametrically opposite sides of the platform 124. The detector array 130 is preferably a two-dimensional array, such as the array described in U.S. Pat. No. 6,091,795 entitled, "Area Detector Array for Computed Tomography Scanning System." Other suitable arrays are known in the art. The system 120 further includes a data acquisition system (DAS) 134 for receiving and processing signals generated by detector array 130, and an X-ray tube control system 136 for supplying power to, and otherwise controlling the operation of X-ray tube 128. The system 120 is also preferably provided with a computerized system (not shown) for processing the output of the data acquisition system 134 and for generating the necessary signals for operating and controlling the system 120. The computerized system can also include a monitor for displaying information including generated images. System 120 also includes shields 138, which may be fabricated from lead for example, for preventing radiation from propagating beyond gantry 125.

As described more fully hereinafter, the X-ray tube 128 includes at least two cathodes and one anode for creating at least two separate, spaced-apart focal spots from which separately controlled X-ray beams can be independently created and generated. These beams shown generally at 132 in FIGS. 1-3, and are more clearly shown in FIGS. 4 and 5, pass through a three dimensional imaging field, through which conveying system 110 transports baggage 112. After passing through the baggage disposed in the imaging field, detector array 130 can receive each beam 132. The detector array then generates signals representative of the densities of exposed portions of baggage 112. The beams 132 therefore define a scanning volume of space. Platform 124 rotates about its rotation axis 127, thereby transporting X-ray source 128 and detector array 130 in circular trajectories about baggage 112 as the conveyor system 110 continuously transports baggage through central aperture 126, so as to generate a plurality of projections at a corresponding plurality of projection angles. When dual energy scanning mode is configured, the control system 136 separately controls the application of high voltages to each of the cathodes, grids and anode of the X-ray tube 128. The detector array 130 then receives data corresponding to high-energy and low-energy X-ray spectra at various projection angles.

Figure 4:
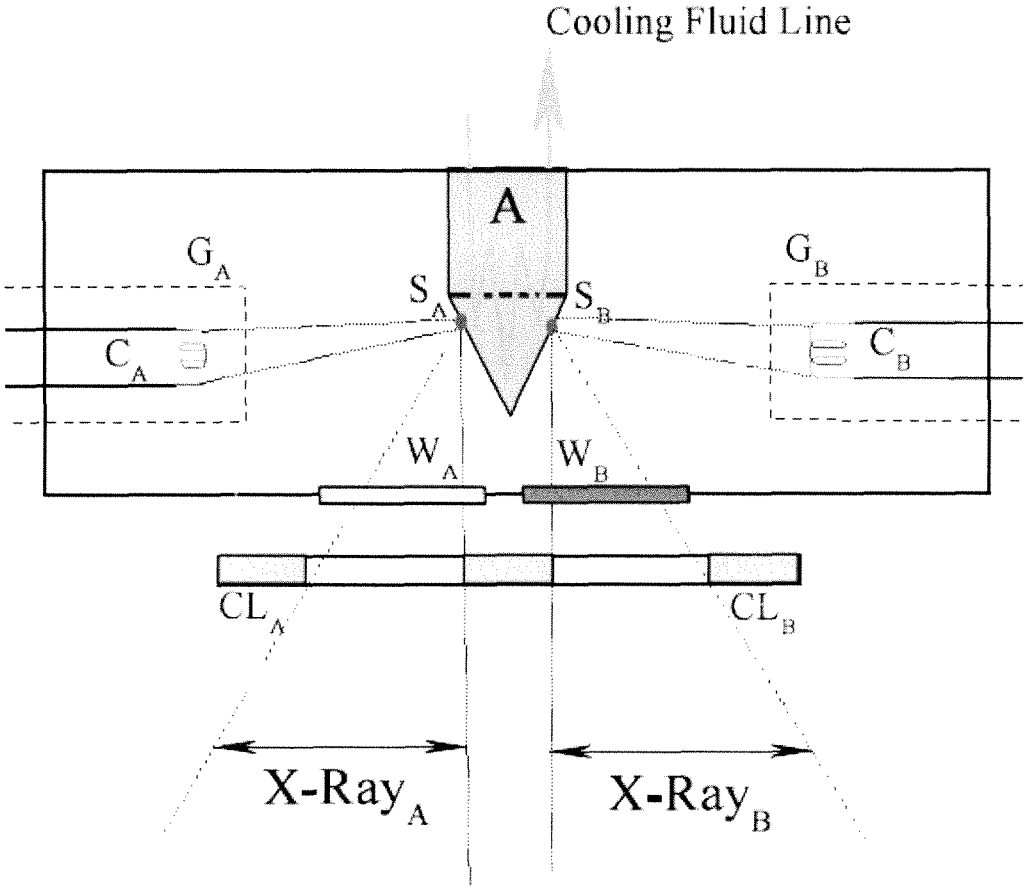
FIG. 4 is a schematic side view of an embodiment of a source of X-rays having a single stationary anode, with two cathodes and associated grids.
Figure 5:
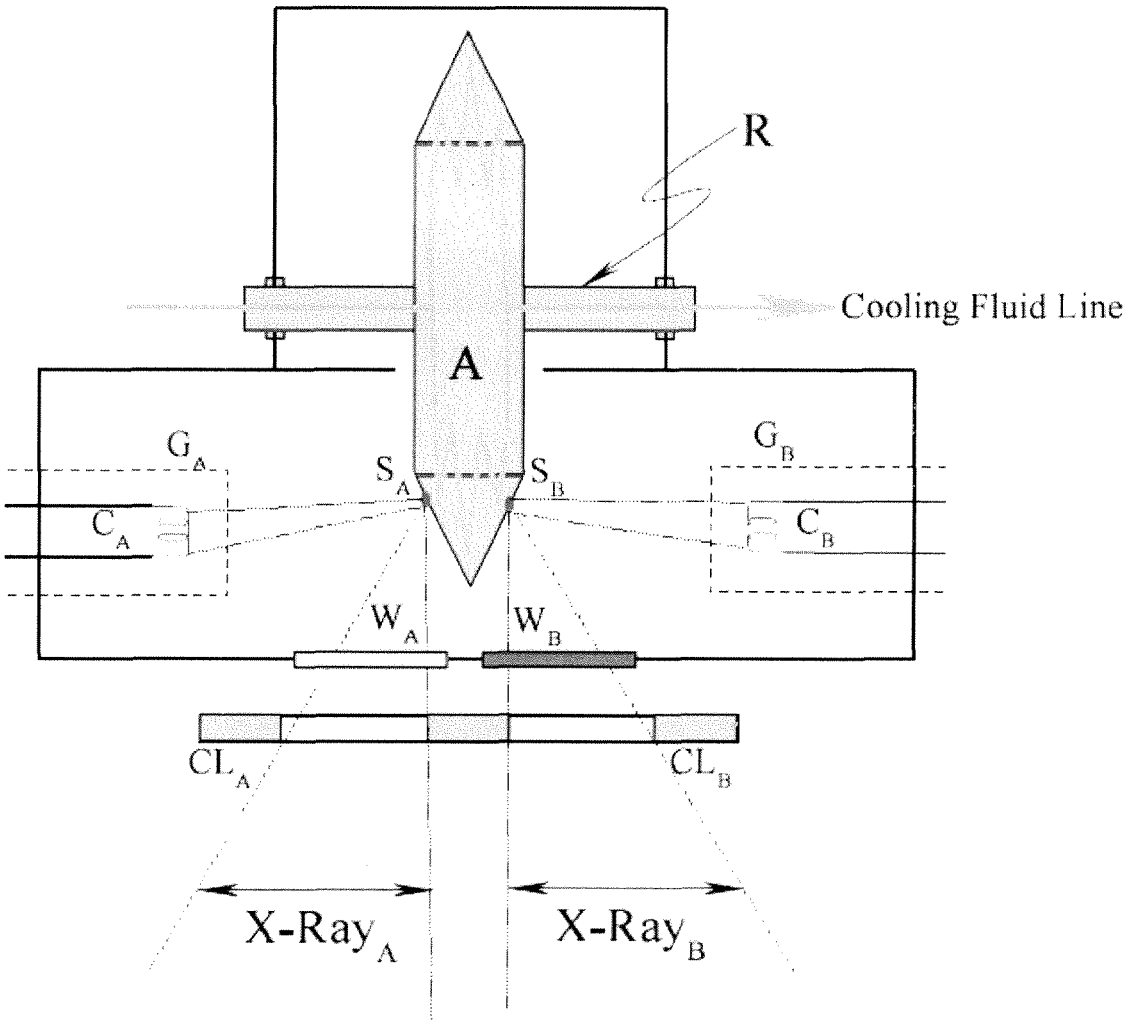
FIG. 5 is a schematic side view of an embodiment of a source of X-rays having a single rotating anode, with two cathodes and associated grids.

Two embodiments of the X-ray source are respectively shown in FIGS. 4 and 5. Both illustrated embodiments comprise a single tube 200 (tube 200A of FIG. 4 including a stationary anode, while tube 200B of FIG. 5 including a rotating anode) enclosing a single or common anode, two cathodes and two control grids mounted in the configuration as shown in each FIG. The cathode 202 generates an electron beam 204 that impinges on the anode 206 to generate X-rays from focal spot 208. The emission of electrons from cathode 202 impinging on focal spot 208 is controlled by controlling the bias voltage applied to control grid 210. Similarly, cathode 212 generates an electron beam 214 that impinges on the anode 206 to generate X-rays from focal spot 218. The emission of electrons from cathode 212 impinging on focal spot 218 is controlled by varying the bias voltage applied to control grid 220. Two separately controlled X-rays beams 222 and 224 are independently generated from the respective focal spots 208 and 218, and exit through two corresponding windows 226 and 228. Windows 226 and 228 can be constructed so as to apply the same or different spectral filtering to the corresponding beams so as to modify the generated spectrum as required. Further, apertures 230 and 232 can be provided for selectively shaping and directing each of the generated beams 234 and 236 as desired depending on the application.

The anode can be stationary, as shown in the embodiment of FIG. 4 at 206A: or the anode can he a rotating anode, as shown in the embodiment in FIG. 5 at 206B. In both embodiments the anodes are cooled by air, or with a suitable cooling fluid flowing through a cooling conduit 234 in the anode 206.

Figure 6:
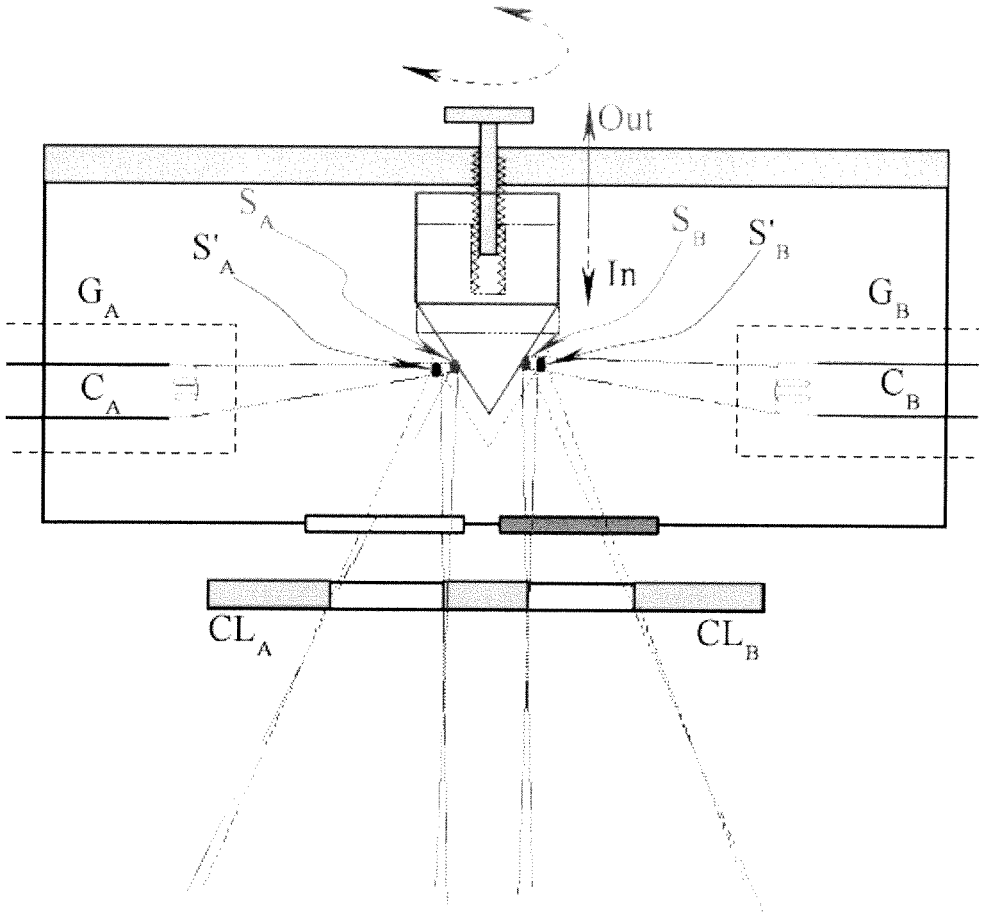
FIG. 6 is a schematic top view of an embodiment of a source of X-rays for producing two focal spots on a common anode, wherein the relative positions of the focal spots and be mechanically adjusted.
Figure 7:
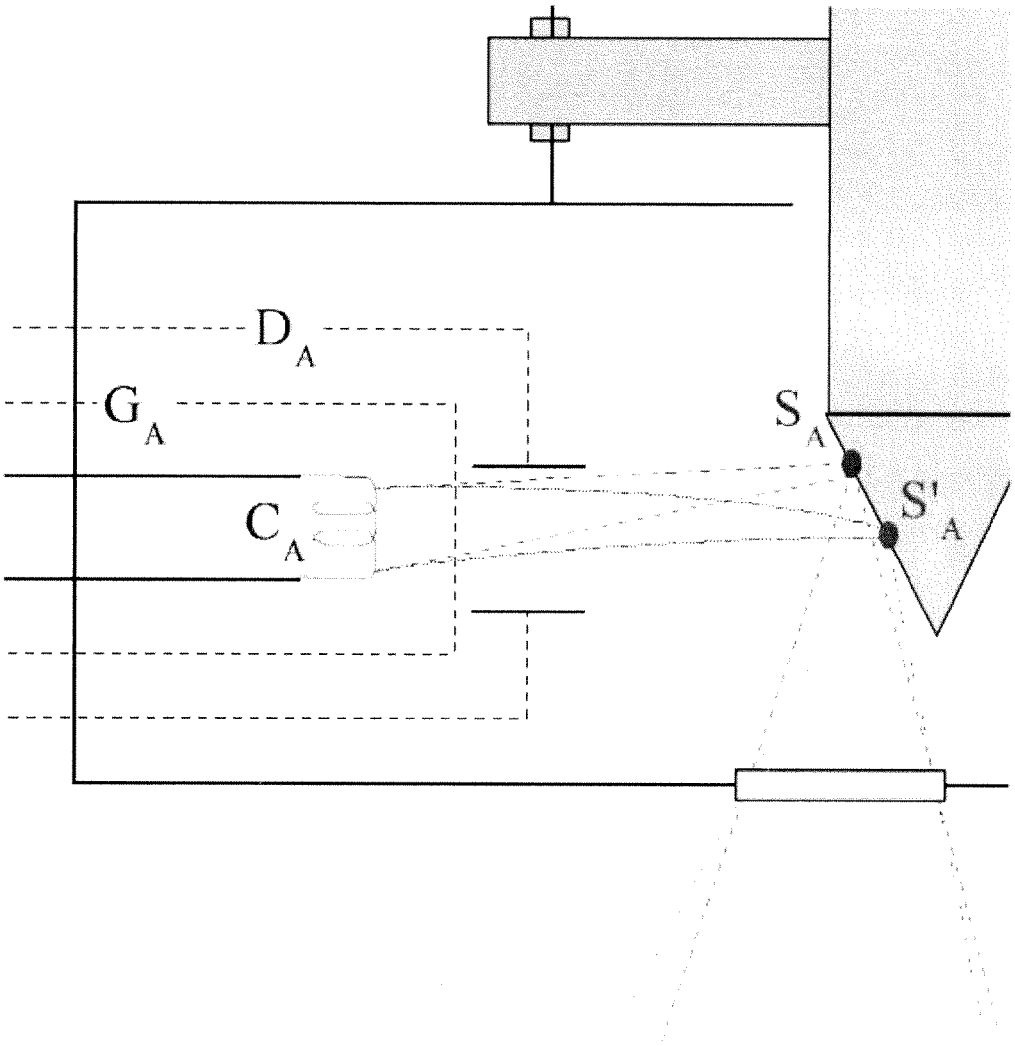
FIG. 7 is a schematic top view of an embodiment of a source of X-rays for producing two focal spots on a common anode, wherein the relative positions of the focal spots and be adjusted using an electric field.

By separately controlling the emission of electrons from the cathodes 202 and 212. as well as the control grids 210 and 220, the X-ray beams 222 and 224 can be simultaneously generated or alternately generated, as desired. The beams can be directed to the same areas of the array, or different areas of the detector array by constructing the apertures 230 and 232. Further by controlling the power applied to the individual cathodes 202 and 212 and the control voltages applied to each of the control grids, the X-ray beams 222 and 224 can be generated at the same or at different flux levels, as well as at the same or at different spectra. The separation between the focal spots can be mechanically adjusted by moving the anode 206C with respect to the cathodes 202 and 212 and control grids 210 and 220, as best illustrated by the embodiment shown in FIG. 6, or by providing an electromagnetic field generator 250 illustrated by the embodiment shown in FIG. 7 and comprising two spaced apart plates (with a differential voltage applied thereto) positioned on opposite sides of the corresponding electron beam, and constructed so as to generate an electromagnetic field for moving the electron beams generated by each cathode through the respective control grid. The beam can be moved relative to the anode and the other focal spots so as to move a focal spot within a spatial range of movement. Further, each of the X-ray beams can be generated through the apertures so they are coincident on the same portion of the detector array, so they overlap each other for some of the detectors, or coincident on entirely different parts of the array so that they do not overlap. The X-ray beams can be continuously generated, or generated in a pulse mode.

Figure 8:
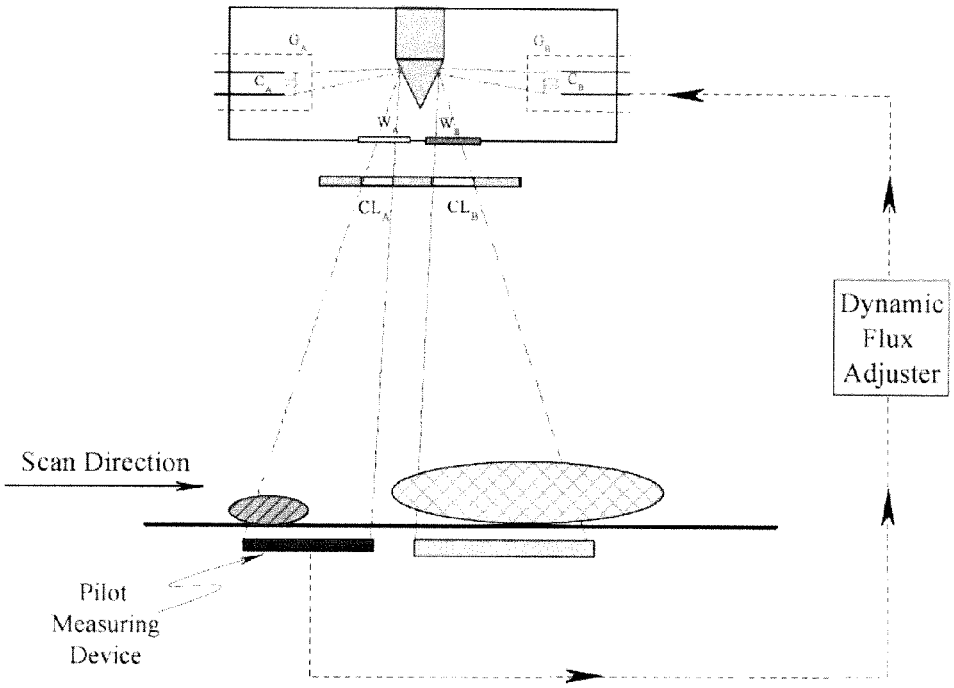
FIG. 8 is a schematic side view of an embodiment of he source for producing two focal spots and a flux adjuster.

The source 200 can also include a flux adjuster configured so as to dynamically adjust X-ray flux of each of the beams. One embodiment of a flux adjuster 260 is shown in FIG. 8 and comprises a pilot measurement device 262 for measuring the flux from one of the beams so as to determine at least one operating parameter for generating the other of the beams. While the embodiments of FIGS. 4 and 5 show the source as including only two cathodes, two grids and a common anode, the tube can be constructed so as to include more than two sets of cathodes and grids sharing a common anode.

While this disclosure has been particularly shown and described with references to preferred embodiments thereof, it will be understood by those skilled in the art that various changes in form and details may be made therein without departing from the spirit and scope of the disclosure as defined by the following claims.

What is claimed is:

1. An X-ray imaging system, comprising:

a source of X-rays including at least two cathodes and at least one common anode operative to generate at least two spaced apart beams of X-rays emanating from respectively different locations of the anode, and separately controlled so as to be generated independently of one another;

a detector array for receiving X-rays from each of the spaced apart beams; and a control system configured to control the position of each location of the anode from which a respective beam emanates and the area of the detector array that each respective beam is directed to, wherein the control system is electro-magnetic and includes a generator for generating an electromagnetic field for each of the beams.

2. An X-ray imaging system of claim 1, wherein the beams are alternately generated

3. An X-ray imaging system of claim 2, wherein the beams are directed to the same areas of the array.

4. An X-ray imaging system of claim 2, wherein the beams are directed to different areas of the array.

5. An X-ray imaging system of claim 1, wherein the beams are simultaneously generated.

6. An X-ray imaging system of claim 5, wherein the beams are directed to different areas of the array.

7. An X-ray imaging system of claim 1, wherein the beams have different X-ray spectra.

8. An X-ray imaging system of claim 1, wherein the beams have different flux levels.

9. An X-ray imaging system of claim 1, wherein the control system is mechanical.

10. An X-ray imaging system of claim 9, wherein the control system is configured to move the anode so as to modify the relative positions of the locations of the anode from which the X-rays emanate.

11. An X-ray imaging system of claim 1, wherein the source is configured so that each of the beams can be generated continuously.

12. An X-ray imaging system of claim 11, wherein the beams do not overlap.

13. An X-ray imaging system of claim 1, wherein the source is configured so that each of the beams can be generated in a pulsed mode.

14. An X-ray imaging system of claim 13, wherein the beams can be generated so that they overlap.

15. An X-ray imaging system of claim 13, wherein the beams can be generated so that they do not overlap.

16. An X-ray imaging system of claim 1, further including a flux adjuster configured so as to dynamically adjust X-ray flux of each of the beams.

17. An X-ray imaging system of claim 16, wherein the flux adjuster includes a pilot measurement device for measuring the flux from one of the beams so as to determine at least one operating parameter for generating another of the beams.

18. An X-ray imaging system of claim 1, wherein the system is a CT scanner.

19. An X-ray imaging system of claim 1, wherein the source is a single X-ray tube.

20. An X-ray imaging system of claim 1, wherein electrons are emitted from each of the cathodes towards the respective locations of the anode, the emission of electrons from each cathode being controlled by a separate grid, and a bias voltage applied to each grid.

21. An X-ray imaging system of claim 1, wherein X-rays emanating from each of location of the anode pass through a corresponding filter for modifying the generated spectra of the X-ray.

* * * * *